United States Patent [19]

Wright et al.

[11] Patent Number: 4,793,254

[45] Date of Patent: Dec. 27, 1988

[54] DOCUMENT AND CARD POSITIONING DEVICE WITH SPRING RELEASABLE BASE

[76] Inventors: A. Glenn Wright, Rte. 4, Box 355, Pittsboro, N.C. 27312; James L. Ross, 1803 Fountain Ridge Rd., Chapel Hill, N.C. 27514

[21] Appl. No.: 155,216

[22] Filed: Feb. 12, 1988

[51] Int. Cl.[4] ..... B41F 1/28; B41F 3/04

[52] U.S. Cl. ..... 101/407 BP; 101/269

[58] Field of Search ..... 101/287, 269, 316, 319, 101/407 BP, 369

[56] References Cited

U.S. PATENT DOCUMENTS

| | | | |
|---|---|---|---|
| 2,013,604 | 9/1935 | Depenbrock | 101/407 BP |
| 2,039,072 | 4/1936 | Dugdale | 101/269 |
| 2,144,849 | 1/1939 | Moore | 101/407 BP |
| 2,245,828 | 6/1941 | Schuh | 101/287 |
| 2,465,494 | 3/1949 | Sullivan | 101/369 |
| 2,596,864 | 5/1952 | Penuer | 101/269 |
| 2,913,981 | 11/1959 | Hermann | 101/269 |
| 3,062,136 | 11/1962 | Lieberman et al. | 101/287 |
| 3,083,641 | 4/1963 | Childs et al. | 101/269 |
| 3,236,177 | 2/1966 | Perry, Jr. et al. | 101/269 |
| 3,402,661 | 9/1968 | Barbour et al. | 101/269 |
| 3,610,148 | 10/1971 | Penaluna | 101/269 |
| 3,654,862 | 4/1972 | Strohschneider | 101/269 |
| 3,818,828 | 6/1974 | Nakada et al. | 101/269 |
| 3,869,201 | 3/1975 | Lysle | 353/120 |
| 3,956,984 | 5/1976 | Kiang | 101/407 BP |
| 4,027,591 | 6/1977 | Gubela | 101/407 BP |

*Primary Examiner*—Eugene H. Eickholt

*Attorney, Agent, or Firm*—Lynn E. Barber

[57] ABSTRACT

A card and form positioning device for easy and accurate alignment of the embossed area of a plastic card with the appropriate area of a form that is to be imprinted. The device has card guide corners and pegs protruding upward from a flat guide base and through the platen of a card imprinting machine. A spring means beneath the guide base pushes the guide corners and pegs through holes in the platen.

11 Claims, 6 Drawing Sheets

DOCUMENT AND CARD POSITIONING DEVICE WITH SPRING RELEASABLE BASE

BACKGROUND OF THE INVENTION

1. Field of the Invention

This invention relates to a card and document positioning device for use with an imprinter and in particular, to a device that utilizes a spring mechanism and pegs to enable positioning of either cards having printing on the bottom or top of the card face or small size cards at the appropriate place for imprinting various sizes of forms.

2. Description of the Related Art

Many organizations that deal with the public utilize plastic identification cards having the name of the customer, client or patient embossed on the face of the cards to imprint the identification information on invoices, order forms or other informational forms. Particularly, in large institutions such as hospitals, although each embossing machine is generally used on only one type of card, more than one card size may be used in various parts of the institution on a variety of different sizes of forms. In addition, cards having the embossed information on the top or the bottom may be used in a particular institutional location to imprint the various sizes of forms.

There are three standard card styles that are often used in institutions such as hospitals. Two of these employ the standard credit card size, known as CR 80, which may be embossed either at the top or bottom of the card. The other card size, known as CR 50, is of a similar width as the CR 80 but is not as large from top to bottom of the face of the card. It may be cut from a card the size of a CR 80 card with one portion of the CR 80-size card being used for a patient arm band and the other portion that is the size of a CR 50 card is used for patient identification cards to imprint forms. A preformed plastic product for this latter use is made by Bio-Logics Products, Inc. (West Jordan, UT).

A number of different embossing machines have been developed commercially to assist in the automated form imprinting process, particularly in large institutional settings. Thus, the AFI Farrington machine (Model 45 Data Recorder, Data Card Corporation, Minneapolis, MN), the Pitney Bowes machine (Model 6700 Electric Plastic Card Imprinter, Pitney Bowes, Stamford, CT) and the National Business Systems machine (Model NBS 306, National Business Systems, Moonachie, NJ) are examples of the most commonly used products for this purpose in hospitals. The latter two machine styles are very similar to each other. The general structure of all of the machines comprises a flat area (platen) on which to place the cards and forms, and a cover containing a roller mechanism that moves over the form on the card when the cover is lowered on top of the flat area. The problem that exists with these machines is that there is no quick, easy and accurate way to align the various forms over the appropriate place on the embossed card before closing the cover.

To solve this problem, a number of makeshift and temporary measures are sometimes taken by those either responsible for use of the machines or trying to increase machine sales. Colored tape may be placed on the surface upon which the cards and forms are placed to indicate where the corners and edges of the cards and forms are to be placed. This requires careful visual alignment of the corners and edges with the tape. Furthermore, the cards may be moved out of place by the action of placing the forms over them and the forms may be moved out of the proper position by the action of shutting the cover of the machine or by the action of the imprinting roller of the machine. Plastic clips designed to hold the smaller cards in place may also be installed on the surface of the machine, but this does not assist in placement of the forms over the cards.

Another suboptimal solution is the placement of a compressible substance such as weather-stripping to mark the appropriate locations. Although this alleviates the problem of placing the forms and cards in the appropriate place, the substance often does not compress sufficiently when the machine cover is brought down resulting in lightly or incompletely imprinted forms because the roller does not produced sufficient pressure on the forms.

Either of these prior solutions also requires that the machines must be retrofitted by addition of the tape or compressible substance after a careful, time-consuming determination of where on the platen to place the particular size and type of cards to be used with that machine.

Although it is standard to have the area for embossing the various forms located in a particular portion of the form such as the upper right corner, the location of other information on the forms very near to the area to be imprinted and the difficulty of accurately placing the appropriate area of the form over the correct area of the card due to the various locations of embossing on the cards and the various sizes of cards, often results in imprinting misplacement. In addition, to cause a disorderly appearance of the imprinted form such misplacement may have more serious consequences. Thus, in the hospital setting, misplacement of the imprinting on a laboratory test result form may make the results unreadable and necessitate repeated tests or lead to inaccurate diagnoses or prescriptions. If the patient name and/or medical record number are unreadable due to imprinting of the information over other printed matter, the wrong patient may be treated or billed depending on the form being used.

Accordingly, it is an object of the invention to provide an device for easily aligning a variety of forms over the appropriate area of embossed cards of a particular size on an imprinting machine.

It is another object of the invention to provide a device constructed so that it may be permanently modified so that it may be used to align any one of the three most common types of embossed card on an imprinting machine.

It is another object of the invention to provide a device for aligning embossed cards and forms that may be installed easily and quickly on a standard imprinting machine.

Other objects and advantages of the invention will be more fully apparent from the following disclosure and appended claims.

SUMMARY OF THE INVENTION

In a broad aspect, the invention relates to a card and form alignment device comprising a base piece, utilization of a spring mechanism below the base piece, guide corners and upward-projecting pegs. The device is preferably constructed of plastic so that pegs that are not to be used may be broken off. The preferred embodiment comprises three pegs that, with the guide corners, serve to align an embossed card of particular size with the imprinting area of a form.

Other aspects and features of the invention will be more fully apparent from the following disclosure and appended claims.

DETAILED DESCRIPTION OF THE INVENTION AND PREFERRED EMBODIMENTS THEREOF

Figure 1:
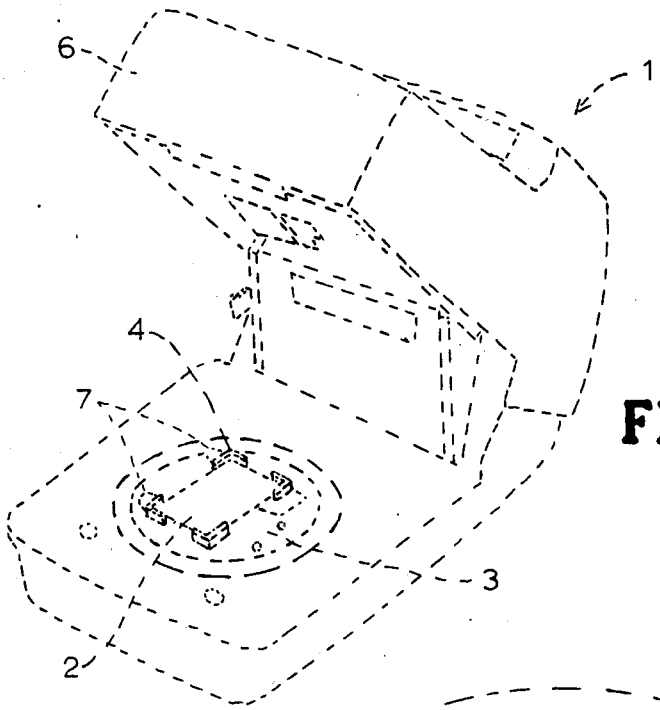
FIG. 1 is a perspective view of a machine upon which the device of the invention is used.
Figure 2:
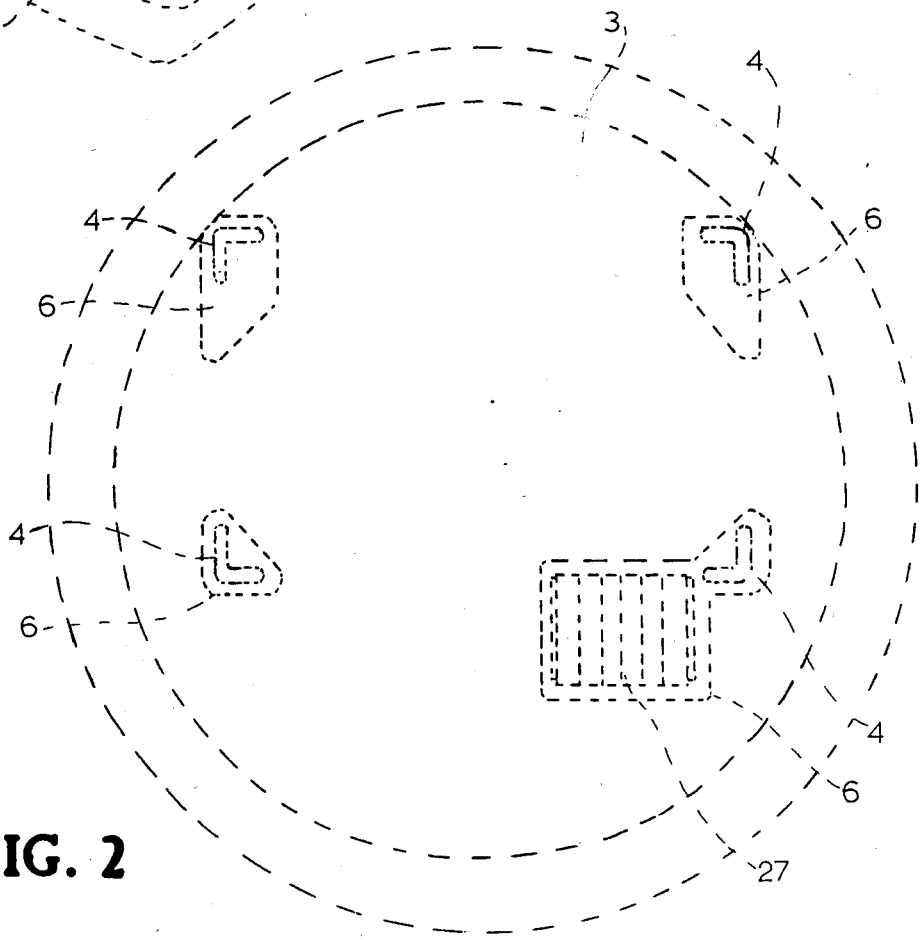
FIG. 2 is a plan view of the platen of a machine used with the invention.
Figure 3:
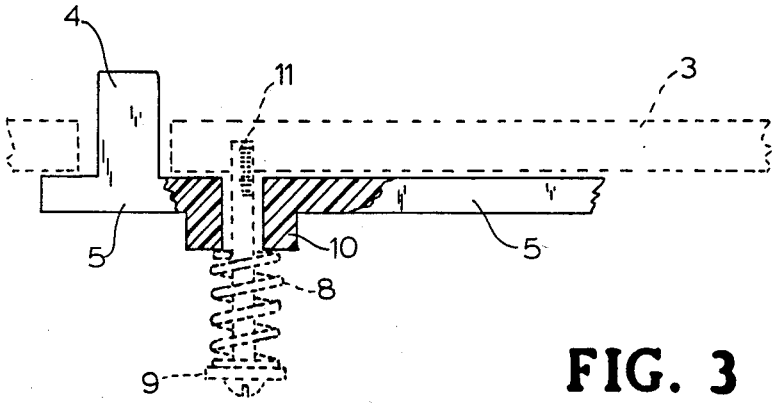
FIG. 3 is a fragmentary cross section of the side of the spring assembly of a machine with which the invention is used.

The preferred embodiment of the device of the present invention is used on the commercially available AFI machine 1 which is shown open to receive a card and form in FIG. 1. As discussed below, the invention is easily adapted for use on other imprinting machines. Using the machine as constructed, an embossed card 2 is placed on the platen 3, within the raised corners 4 of a plastic spring-loaded cardguide form 5 that is beneath the platen 3 (FIG. 2). The raised corners 4 protrude upward through corner holes 6 in the platen 3 when the cover 7 of the machine 1 is open and the machine 1 is not in use. One of the corner holes 6 is enlarged to expose a date printer 27. The platen 3 is held in this position by means of two springs 8 each of which is seated on a washer 9 and pushing upward on a spring flange 10 on the bottom of the cardguide form 5. FIG. 3 is a cross-sectional view of a spring 8 and one of the raised corners of the cardguide form 5. A screw 11 goes through the washer 9, is surrounded by the spring 8 and extends through a spring flange hole 12 in the cardguide form 5 and attaches to the platen 3. When the cover 7 of the machine 1 is lowered to the platen 3, it pushes down the raised corners 4 of the cardguide form 5 and the cardguide form 5 is pushed downward, compressing the coils of the spring 8 on to the washer 9.

Figure 4:
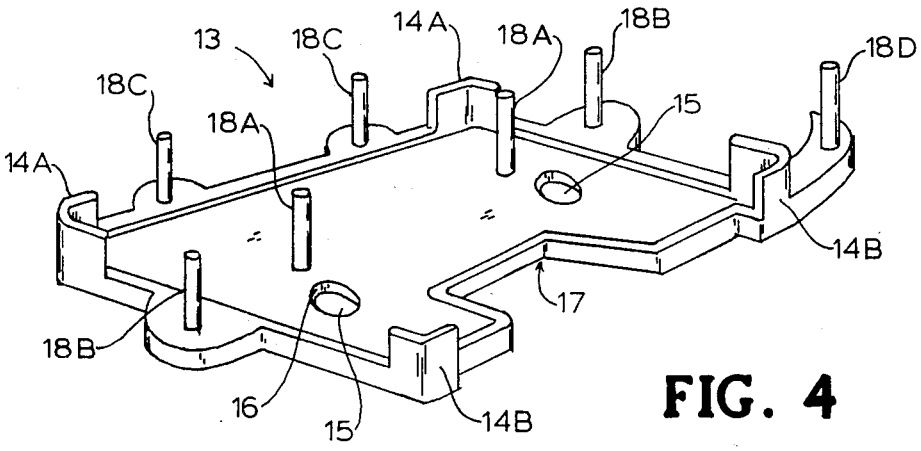
FIG. 4 is a perspective view of the guide of the invention.

The device of the invention replaces the cardguide form 5 when used with the AFI machine 1. A preferred embodiment of the guide 13 of the invention is shown in FIG. 4. The guide 13 is preferably comprised of four guide corners 14 that fit within the corner holes 6 of the platen of the machine 1. Two spring-holes 15 and surrounding flanges 16 are placed in the guide 13, in the analogous position to that of the spring flange 10 on the cardguide form 5, to enable the guide 13 to be spring-controlled in the same manner as the cardguide form 5 is controlled. An indentation 17 in the generally rectangular shape of the piece that comprises the guide 13 is designed to fit around the various components of the machine 1 that are beneath the platen 3 and is not otherwise a material part of the invention.

Figure 6:
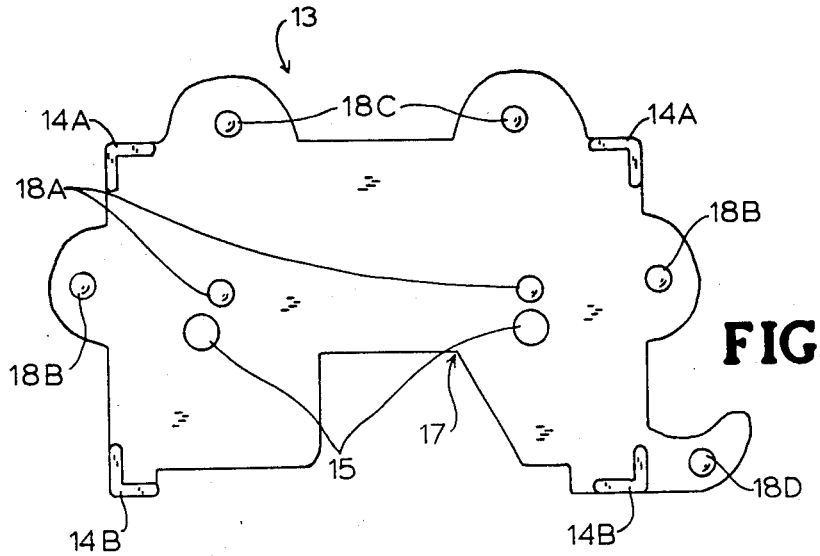
FIG. 6 is a plan view of the top of the guide.

The embodiment of the guide 13 shown in FIGS. 4 and 6 further comprises seven pegs 18, referred to herein as the two central pegs 18A, the two side pegs 18B, the two top pegs 18C and the outer peg 18D. The pegs 18 are preferably somewhat higher than the guide corners 14 so that it is easier to place the forms accurately on the cards even if the guide corners 14 are beneath the forms. As discussed in more detail below, in the preferred embodiment only three of the pegs 18 are generally used for a particular card type.

The guide 13 including the pegs 18 are preferably molded of plastic so that the unneeded pegs for particular uses may easily be broken off prior to use. Alternatively, three different guide models each having a different peg arrangement may be constructed of other materials such as metal. Pegs of various materials may also be constructed to be screwed into threaded holes or otherwise fitted into holes in the guide 13 to allow placement of the pegs in the holes that are appropriate for a particular use.

Figure 5:
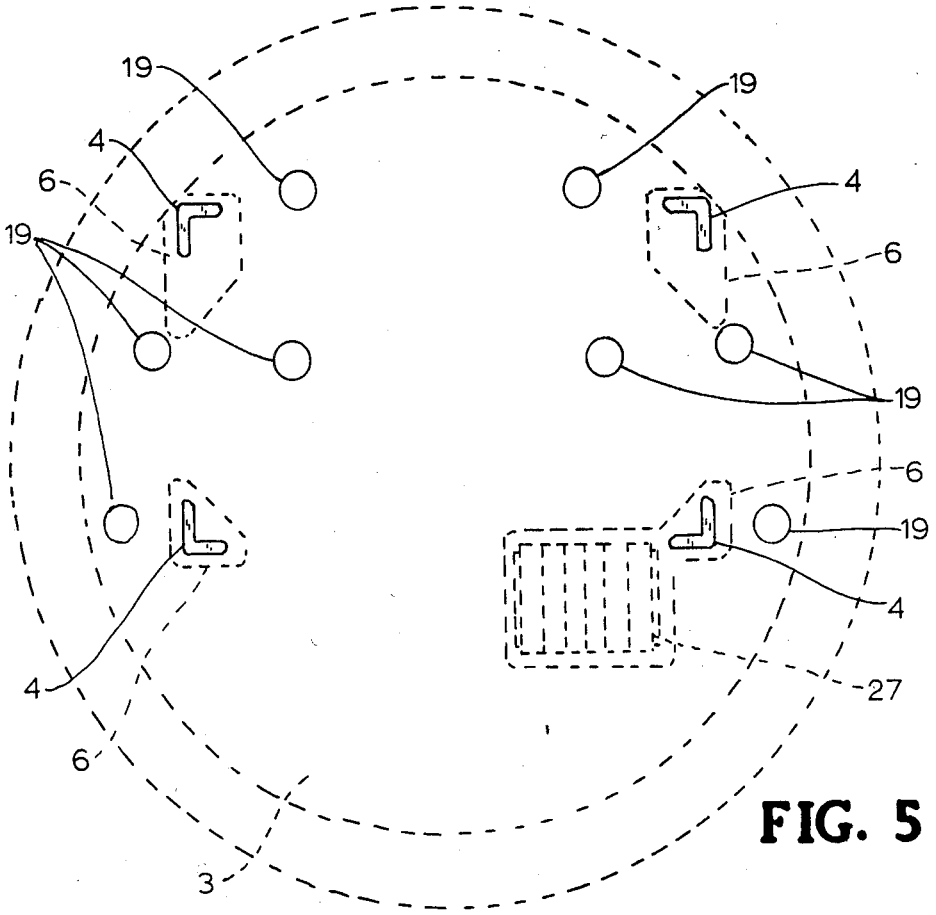
FIG. 5 is a plan view of the platen of a machine adapted for use with the guide of the invention.

To accommodate placement of the peg-bearing guide 13 beneath the platen 3, the platen 3 for the machine 1 may be constructed with 7 peg-holes 19 (FIG. 5), or three correctly positioned peg-holes 19 for the desired use may be drilled in platens currently in use. To assist in proper placement of the peg-holes 19 in the previously manufactured platens, a drilling pattern piece showing the correct hole location can be provided to the customer with the guide 13. The pegs 18 protrude through the peg-holes 19 in the platen 3 when the cover 7 is open. The springs 8 hold the guide 13 tightly against the platen 3 and are pushed down when the cover 7 is closed. The cover pushes down the pegs 18 and the guide corners 14 of the guide 13.

Figure 7:
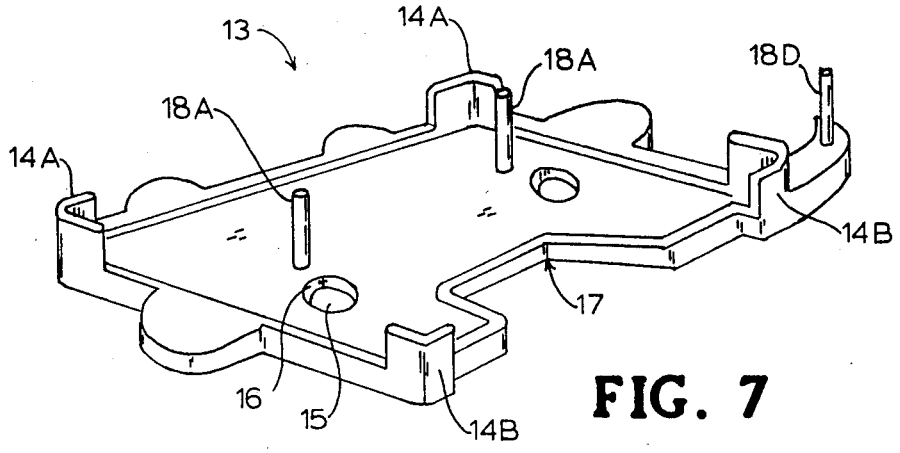
FIG. 7 is a perspective view of one embodiment of the invention.
Figure 8:
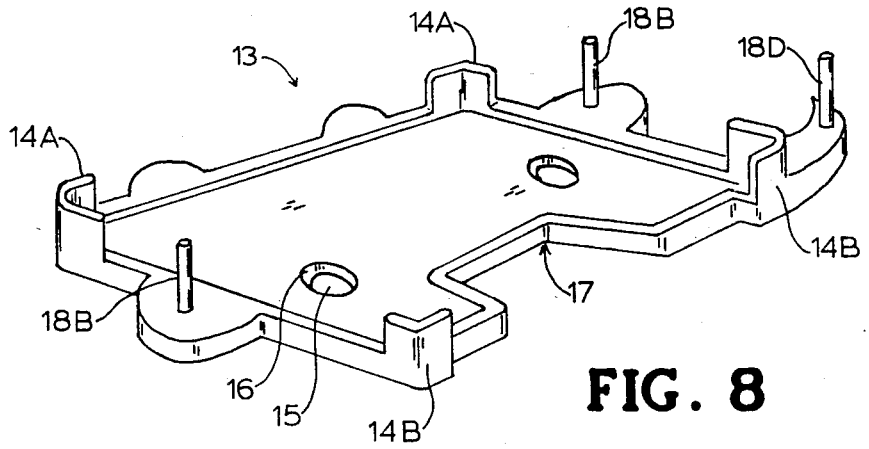
FIG. 8 is a perspective view of another embodiment of the invention.
Figure 9:
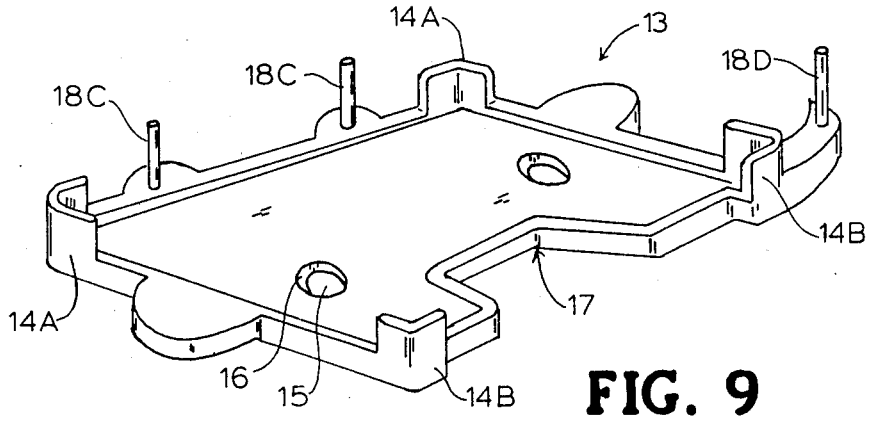
FIG. 9 is a perspective view of another embodiment of the invention.
Figure 10:
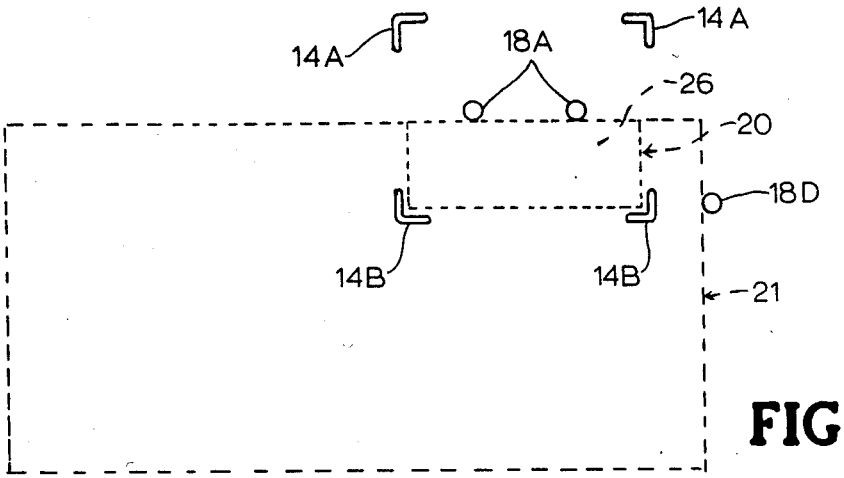
FIG. 10 is a schematic drawing of use of an embodiment of the invention.

Three preferred embodiments of the guide 13 showing the peg arrangements for use with different cards are shown in FIGS. 7–9. In FIG. 7, the two central pegs 18A and the outer peg 18D are present on the guide 13 and pegs 18B and 18C are absent. This allows forms having the typical upper right imprinting area to be properly aligned with a CR 50 card 20 or similar size card. As shown in FIG. 10, the central pegs 18A and the lower guide coners 14B form the space for placement of the CR 50 card 20. The central pegs 18A and the outer pegs 18D are used to align the upper right hand corner of any form 21 so that the form 21 is in the correct orientation and placement with respect to the CR 50 card 20. Although the above-described peg arrangement is preferred for the CR 50 card 20, it will be appreciated that it is not necessary to have the upper guide corners 14A in this embodiment. Also, if there are two central pegs 18A, there need only be one lower guide corner 14B.

Figure 11:
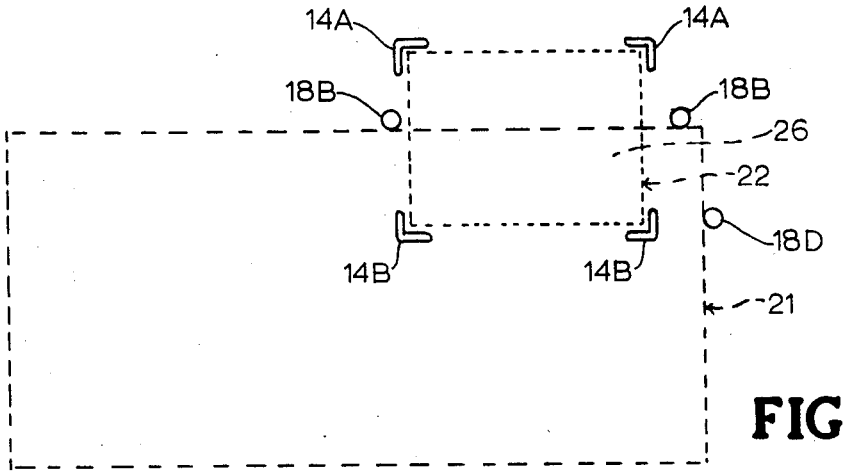
FIG. 11 is a schematic drawing of use of an embodiment of the invention.

In FIG. 8, the side pegs 18B and the outer peg 18D are present on the guide 13 and pegs 18A and 18C are absent. This allows forms having the typical upper right imprinting area to be properly aligned with the card imprinted area 26 of the bottom half of a CR 80 card 22. As shown in FIG. 11, the upper guide corners 14A and the lower guide corners 14B form the space for placement of the CR 80 card 22. The side pegs 18B and the outer peg 18D are used to align the form 21 so that the bottom half of the CR 80 card 22 is imprinted in the correct space on the form 21.

Figure 12:
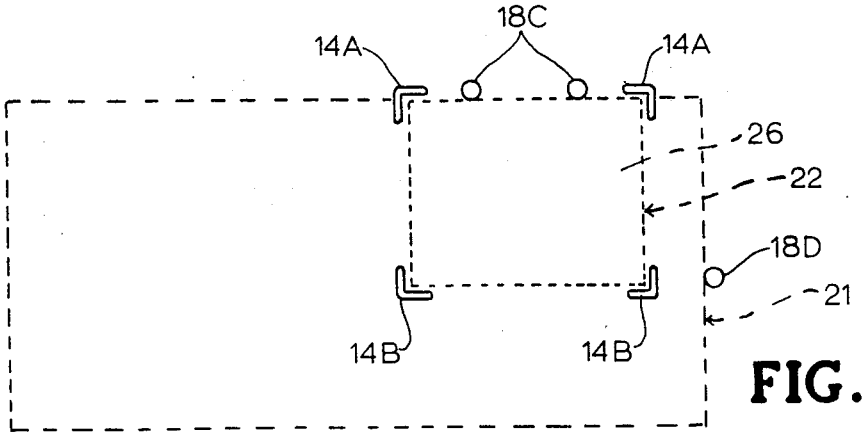
FIG. 12 is a schematic drawing of use of an embodiment of the invention.

In FIG. 9, the top pegs 18C and the outer peg 18D are present on the guide 13, and pegs 18A and 18B are absent. This allows the typical forms to be properly aligned with the top half of a CR 80 card 22. As shown in FIG. 12, the upper guide corners 14A and the lower guide corners 14B again form the space for placement of the card imprinted area 26 of CR 80 card 22. Unlike the embodiment shown in FIG. 11, top pegs 18C, instead of the side pegs 18B, along with the outer peg 18D, are used to align the form 21 so that the top half of the CR 80 card 22 is imprinted in the correct space on form 21.

Figure 13:
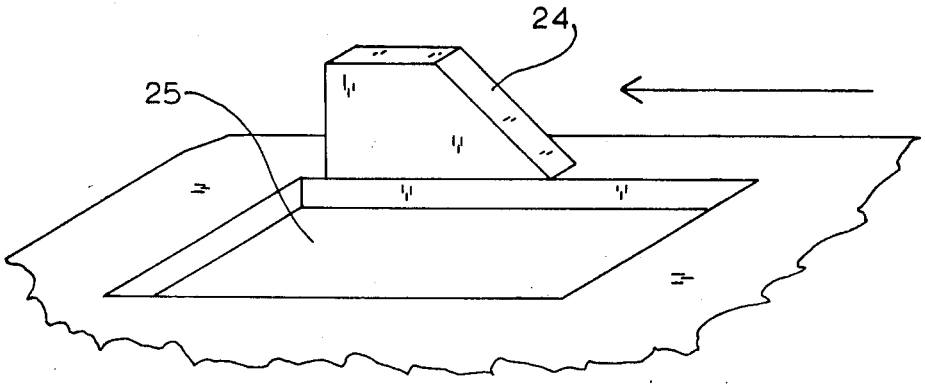
FIG. 13 is a fragmentary cross-sectional view of one embodiment of the guide.

The guide 13 of the invention may also be modified to fit on the Pitney Bowes and the National Business Systems machines. Because these machines rely on the motion of the imprinting roller, rather than the pressure of a cover, to press a cardguide form down so that imprinting can occur, the main modification of the guide is to modify the shape of the guide used in these machines to provide a surface on the guide that is pressed down when the roller moves across the form. As shown in FIG. 13, the Pitney Bowes type guide 23 of the invention has an angled guide piece 24 that is slanted away from the direction of movement of the roller when imprinting as shown by the arrow. The general shape of the guide 23 is constructed as that of the cardguide of the machines as manufactured but in addition has the peg arrangement of guide 13 except that the angled guide piece 24 replaces the pegs 18C. The angled guide piece 24 is also provided to align the top of the form. The preferred position of angled guide piece 24 is next to the date stamp hole 25 and protrudes upward through a hole in the platen 3 positioned where the holes for pegs 18C are positioned for guide 13.

Figure 14:
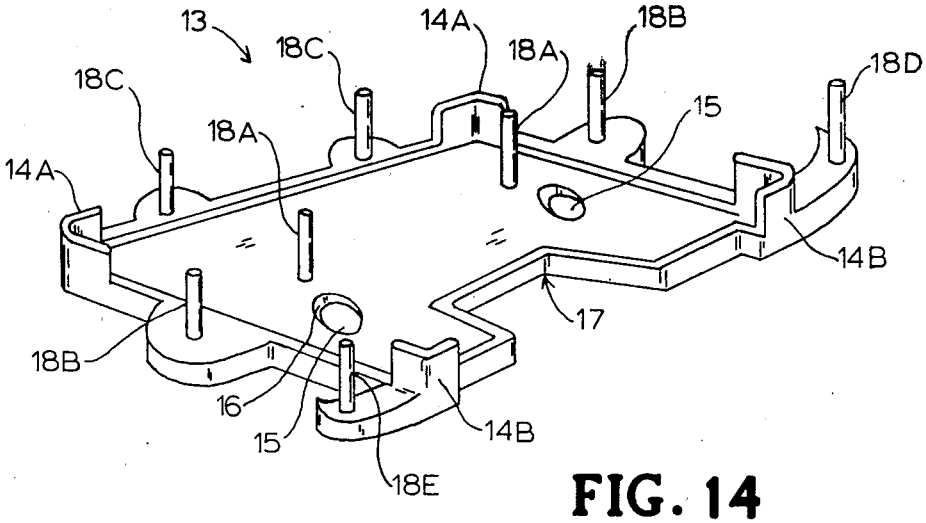
FIG. 14 is a perspective view of one embodiment of the guide.

For routine use with forms having the imprinting area in another place than the upper right hand corner, such as in the upper left hand corner, it is clear that the elements of the invention may be easily adapted by changing the relative placement of the pegs and guide corners and the shape of the guide during manufacture of the device to accommodate the new peg locations. As shown in FIG. 14, for use with left corner forms the guide 13 may be manufactured with a second outer peg 18E on the opposite side of guide 13 from peg 18D to allow alignment of the upper left hand corners of forms with the various sizes of cards. Peg 18D or peg 18E is broken off of guide 13 for use for left corner forms or right corner forms, respectively. It is clear that the positioning of the left corner forms and the various cards on the device would be the mirror image of those shown in FIGS. 10–12.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A card and document positioning device for use with an identification card imprinter having a platen, comprising:

(a) a guide base positioned beneath the platen, said platen having therethrough a plurality of guide corner holes and a plurality of peg holes;

(b) a plurality of guide corners extending upward from the guide base for positioning an identification card;

(c) a plurality of pegs extending upward from the guide base; and (d) a depressible spring means for vertically positioning the guide base beneath the platen so that the guide corners protrude upward through the guide corner holes and the pegs protrude upward through the peg holes in the platen.

2. The positioning device of claim 1, wherein the pegs that are not to be used may be removed from the guide base.

3. The positioning device of claim 2, wherein the pegs comprise an outer peg, and three pairs of pegs, said pairs of pegs comprising two upper pegs, two side pegs and two central pegs, said pegs positioned so that selective removal of two pairs of pegs results in a remaining peg arrangement useful for aligning a particular size of card with an imprinting area of a form.

4. The positioning device of claim 3, wherein the remaining pegs are the outer peg and the two central pegs and the device is useful for aligning a CR 50 size card with a form.

5. The positioning device of claim 3, wherein the remaining pegs are the outer peg and the two side pegs and the device is useful for aligning the bottom of a CR 80 size card with a form.

6. The positioning device of claim 3, wherein the remaining pegs are the outer peg and the two upper pegs and the device is useful for aligning the top of a CR 80 size card with a form.

7. The positioning device of claim 1, wherein the device is constructed with three pegs.

8. The positioning device of claim 7, wherein the pegs comprise an outer peg and two central pegs, and the device is useful for aligning a CR 50 size card with the imprinting area of a form.

9. The positioning device of claim 7, wherein the pegs comprise an outer peg and two side pegs and the device is useful for aligning the bottom of a CR 80 size card with the imprinting area of a form.

10. The positioning device of claim 7, wherein the pegs comprise an outer peg and two upper pegs, and the device is useful for aligning the top of a CR 80 size card with the imprinting area of a form.

11. A card and document positioning device for use with an identification card imprinter having a platen, comprising:

(a) a guide base positioned beneath the platen, said platen having therethrough a plurality of peg holes;

(b) a plurality of pegs extending upward from the guide base;

(c) an angled guide piece extending upward from the guide base; and (d) a depressible spring means for vertically positioning the guide beneath the platen so that the pegs protrude upward through the peg holes in the platen.

* * * * *